US009441650B2

(12) United States Patent
Zou

(10) Patent No.: US 9,441,650 B2
(45) Date of Patent: Sep. 13, 2016

(54) FLUID RESISTANCE REDUCING METHOD AND RESISTANCE REDUCING PROPULSION DEVICE

(76) Inventor: Lisong Zou, Guangzhou (CN)

( * ) Notice: Subject to any disclaimer, the term of this patent is extended or adjusted under 35 U.S.C. 154(b) by 911 days.

(21) Appl. No.: 13/509,607

(22) PCT Filed: Nov. 15, 2010

(86) PCT No.: PCT/CN2010/078732

§ 371 (c)(1),
(2), (4) Date: May 12, 2012

(87) PCT Pub. No.: WO2011/057583

PCT Pub. Date: May 19, 2011

(65) Prior Publication Data

US 2012/0227819 A1 Sep. 13, 2012

(30) Foreign Application Priority Data

Nov. 13, 2009 (CN) ..... 2009 1 0198742

(51) Int. Cl.

| | |
|---|---|
| ***F15D 1/02*** | (2006.01) |
| ***F15D 1/10*** | (2006.01) |
| ***F15D 1/00*** | (2006.01) |

(52) U.S. Cl.

CPC ..... *F15D 1/02* (2013.01); *F15D 1/007* (2013.01); *F15D 1/10* (2013.01); *Y10T 137/0318* (2015.04); *Y10T 137/2224* (2015.04)

(58) Field of Classification Search

CPC ..... F15D 1/00; F15D 1/02; F15D 1/007; F15D 1/10

USPC ..... 137/833

See application file for complete search history.

(56) References Cited

U.S. PATENT DOCUMENTS

| | | | | |
|---|---|---|---|---|
| 3,921,985 | A * | 11/1975 | Fimml | 277/411 |
| 9,261,119 | B2 * | 2/2016 | Hof | F15D 1/06 |
| 2013/0284272 | A1 * | 10/2013 | Hof | F15D 1/06 137/1 |

FOREIGN PATENT DOCUMENTS

| | | | | |
|---|---|---|---|---|
| WO | WO 2007012267 | A1 * | 2/2007 | F15D 1/00 |

* cited by examiner

*Primary Examiner* — Eric Keasel

(57) ABSTRACT

A fluid resistance reducing method and a resistance reducing propulsion device are disclosed, wherein vane-shaped devices are inserted in the fluid at a certain interval along a vertical direction to a moving velocity direction of the fluid, and thus the fluid is divided into several limited zones to limit the fluid and solidify moving state; resultantly the fluid is prevented from directly crashing with fixed wall of a surface of an object to be resistance-reduced and thus a moving velocity direction of the vane-shaped device accords with a predetermined direction of a tangent line of the fixed wall and reaction force on the fluid provides a centripetal force for the fluid to turn, so as to force the fluid to gradually change the velocity direction along the fixed wall and manually intervene with parts of the object to force the fluid near a boundary face to moves stratifiedly and orderly.

17 Claims, 13 Drawing Sheets

FLUID RESISTANCE REDUCING METHOD AND RESISTANCE REDUCING PROPULSION DEVICE

CROSS REFERENCE OF RELATED APPLICATION

This is a U.S. National Stage under 35 USC 371 of the International Application PCT/CN2010/078732, filed Nov. 15, 2010.

BACKGROUND OF THE PRESENT INVENTION

1. Field of Invention

The present invention relates to a method for reducing fluid resistance including frictional resistance, viscous pressure resistance and similar resistances and propelling (adding pressure), and typical application devices realized in multi-fields.

2. Description of Related Arts

In the long term search for fluid resistance reducing methods, attention is only focused on and limited to the shape, i.e., an exploration of streamlines of objects. Air resistance reduction designs of high-speed trains, missiles, automobiles and etc. still remain on this stage. After the establishment of boundary layer theory and several years' development, conventional resistance reducing methods are divided into four categories based on different ways of reducing viscous resistance. The first category includes methods of partially changing the fluid near boundaries, such as hovercraft technology and air lubrication technology. The first category has a considerable potential to reduce resistance. However, practical technology and technological measures of replacing viscous fluids having quite different viscosity and specific gravity on all the boundaries remain to be completely solved, and thus promotion thereof is difficult. The first category is mainly applied in transportation and mechanical engineering. The second category changes velocity distribution on the laminar boundary layer by changing and controlling temperatures of the boundary layer or through suctions so as to reduce viscous resistance. The second category is usually applied in the field of external flow such as aviation, as discussed with details in many monographs, and has limited effects of reducing resistance. The third category reduces resistance through injecting polymer dilute solution in mural areas and can be applied in fluid resistance reduction such as crude oil and water. However, high polymers are expensive and readily ineffective under shearing forces. Resistance reduction effects thereof are limited. The fourth category uses proper boundary materials such as elastic materials to form flexible and smooth boundary which tends to produce dynamic response and vibrate with fluctuation of T-S wave on the laminar boundary layer. The fourth category derives from bionics, but has limited resistance reduction effects. Researches of reducing shape resistance mainly remain on the exploration of the streamlines of objects and also include some other technologies. For example, a channel connecting the head and the tail is arranged in the internal of the object to be resistance-reduced, in such a manner that the fluid moves from the leading end to the trailing end through the channel and pressure different between the leading end and the trailing end is reduced to further reduce viscous pressure resistance, similar to water jet propulsion technology; however, shape resistance of the entrance of the channel and the fluid frictional resistance on the internal surface are relatively large so as to impact the effects of reducing resistance and limits practically applied places. Another example allows boundary face of an object to move with fluid, which is early discovered and has been proved by visual experiments. However, this technology is nearly forgotten because of difficulty in realization and practical application and technical solutions thereof have limited effects of reducing resistance. These conventional resistance reducing methods are discussed in various teaching materials and monographs about resistance reduction mechanics; various conventional propulsion devices (with pumping devices) are mainly for providing propelling forces or pressure and have nothing to do with the fluid resistance reduction.

The inventor discloses "method for reducing fluid resistance and apparatus for the same" in an international application, PCT/CN2006/001825, filed 2006. The inventor also got a Chinese patent of ZL200610106732.4 having an approximately same invention in a manner of resistance reducing propulsion device. The method for reducing resistance includes providing at least one level of movable walls in turn on surface of the object to be resistance-reduced, in such a manner that the boundary face is separated with the object surface and moves with the fluid, wherein the one level of movable walls comprises at least one layer wall; replacing fluids near the surface through manual intervention to produce stratified fluids moving orderly in certain manner, wherein each layer respectively moves at a certain relative velocity, in such a manner that the boundary face reduces the relative velocity to the fluid through relatively small moving resistance and even moves faster than the fluid so as to reduce even eliminate the fluid resistance. For the external flow manner and some internal flow manner, multiple layers of movable walls are arranged on the surface of the internal channel connecting the leading end and the trailing end of the object and at the two sides of the object. When a driving device is used to apply driving forces on the movable boundary face to produce a moving velocity of the boundary face larger than the fluid velocity or to apply driving forces on the fluid, propelling forces emerge while negative pressure emerges in the front part and positive pressure emerges in the back part, in such a manner that a part of viscous resistance is counteracted and fluid frictional resistance disappears, even the shape resistance can be reduced in the condition of the external flow manner. The invention discloses a method that the fluid near the boundary layer moves stratifiedly and orderly through manual intervention to reduce the fluid frictional resistance and the complete typical device for applying manual intervention on the fluid movement. The complete typical device mainly simulates a belt conveyer which supports moving belt with supporting rollers, uses many rolling cylinders to support various film structures moving in circulations to form the so-called "movable walls", and drives the fluid near each "movable wall" of each layer to move stratifiedly and orderly by allowing multiple layers of "movable walls" arranged on the surface of the object to be resistance-reduced to move stratifiedly and orderly because a relative velocity between the fluid near the boundary face and the boundary face is zero.

The operating environment of the present invention is over ideal and the manual intervention device for realizing the objects are confronted with many difficult problems to be solved. Taking the condition of external flow manner as an example, the fluid frictional resistance always appears with the shape resistance. The conventional moving objects commonly have streamlines, while the circulating path of the device is straight. The stream line can be destroyed by adding a manual intervention device on external surface of a conventional moving object to produce new shape resistance. The manual intervention device is ineffective in reducing the shaped resistance no matter in the condition of external flow manner or in the condition of internal flow manner, except working as a propeller, when the pressure difference between the head and the tail is partially reduced by suction effect, which is similar to water jet propulsion, and thus the loss usually outweighs the gains. Furthermore, in the condition of external flow manner, the operating environment is always quite harsh, while the device seldom has a big resistivity to the unbalanced pressure vertical to the moving direction thereof because the flexible films of the "movable boundary" has no hole and thus the counter-flow area is relatively large. In the practical application, the unbalanced pressure such as a slightly huge wave and slightly large airflow is able to deform the "movable walls" to produce contact frictions even to destroy the operation of the device. If a "caterpillar belt" is used or rolling cylinders are densely arranged to form a stream line, mechanical resistance may be increase and a series of problems can be caused. In the condition of internal flow manner, a large number of rotating components including bearings and rolling cylinders are used, and these rotating components are readily damaged and needs plenty of maintenance. Most of these rotating components are fixed on the original positions, and even the movable flexible films are limited on a certain area, so it is difficult to repair. For example, frequently opening an oil pipeline or a coal water mixture pipeline of hundreds of kilometers long or a long-distance water transferring pipeline to repair various components in fragments, and adding lubricant oil on the bearings are both unacceptable in practical operations. Each movable wall and each layer of movable walls are separated by certain space. In the condition of internal flow manner, many components are provided inside pipes and channels having narrow space and thus effective flow area is further reduced, which further limits the application. Moreover, the internal flow pipe or channel is not always straight and inevitably has many turnings, ascents and descents. If each turning is formed by jointing several straight portions, not only partial loss is not reduced but also new partial resistance is caused; if the fluid therein is accelerated, despite the fact that a part of frictional resistance can be reduced, newly caused partial resistance is so considerable that the internal flow pipe or channel is unfit for the practical application. Many other problems also exist.

SUMMARY OF THE PRESENT INVENTION

An object of the present invention is to overcome the above disadvantages and provide a fluid resistance reducing method and its resistance reducing propulsion device based on an improvement to "method for reducing fluid resistance and apparatus for the same" in the invention of PCT/CN2006/001825 recited in the description of related arts, wherein the improved resistance reducing method is added with a new ability to reduce shaped resistance efficiently and has typical application devices respectively in fields of internal flow manner, external flow manner and rotating flow manner; the accordingly improved "resistance reducing propulsion device with multiple movable walls" for reducing fluid frictional resistance forms a complete system to produce more compact practical application products in various application fields, so as to be fit for relatively small pipes and channels, to adapt to operation on curved surfaces and become thinner, to better resist unbalanced forces, to omit most rotating components fixed on original positions such as bearings and rolling cylinders for convenient maintenance and to replace various conveyors in various places. The resistance reducing method and its resistance reducing propulsion device of the present invention are able to efficiently reduce the fluid frictional resistance and the shape resistance including other similar resistance, to be widely applied in fields including water conservancy, aviation, navigation, underwater sports, transportation, national defense and pipeline transportation for reducing fluid resistance and to propel or add pressure.

In order to realize the above object, the present invention adopts following technical solutions.

Firstly, one-way circulation path is realized as follows.

At least one movable thin shell, at least one layer of thin films or other solid elements, i.e., the "movable walls" as recited in description of related arts, are provided on surface of an object to be resistance-reduced. The thin shell, the thin film or the other solid element has a similar shaped with the surface of the object; the thin shell, the thin film or the other solid element moves from the surface of the object (a bow part or a head of a moving object in a condition of external flow manner, and an origin point of pipe or channel in a condition of internal flow manner) and moves stratifiedly and orderly along a moving direction of the fluid until reaching a tail of the surface of the object (a tail of the moving object in the condition of external flow manner and destination of the pipe or the channel in the condition of internal flow manner). According to the description of related arts, a return path is along one side of the object to be resistance-reduced for next circulation. The present invention has a different return path to return to the origin point, i.e., the one-way circulation path.

An application in the field of internal flow is usually embodied as a system for transferring fluids or solid matters. The system of the present invention, similar to the description of related arts, is improved and different. As shown in FIG. 1 and FIG. 34, the system includes an origin handling device 1, a destination handling device, external pipes, an internal pipe (and special packing containers), suspending lubricant fluid 93, resistance reducing films 92 and 94 and a driving device 107/110 (or an energy and power supplying device). An enclosed system is produced by providing the origin handling device at the origin point, providing the destination handling device at a destination point, and smoothly connecting therebetween with external pipes resistant to fluid pressure and returning external pipes along the different return path from the destination point, wherein the smooth connection means a relatively large radian of each turning pipe used for turnings, ascents and descents and no sudden turnings. The internal pipe for containing and conveying the fluid or the solid matters is rigid and able to move inside the external pipes and can be opened and closed. After being handled by the origin handling device, the internal pipe and the resistance reducing films move forwardly at a predetermined velocity gradient, reach the destination point after the turnings, the ascents and the descents and, after being handled by the destination handling device, are orderly opened one wall after one wall to unload; then the internal pipe and the resistance reducing films close up reversely, return along the moving external pipes back to the origin handling device for being handled, are reopened, reloaded and reclosed and enter a next circulation, i.e., the one-way circulation path. Thus almost all the movable components regularly pass any point on the circulation path. Maintenance and replacement point can be optionally provided, so that the difficult maintenance problem as recited in the description of related arts is solved and the device is simplified to be fit for relatively small pipes and channels. Suspending fluid, also as lubricant fluid, fills in a whole system between the internal pipe and the external pipes, which is similar to a long and narrow fluid connector, so as to form an enclosed suspension system. A special processing machine is provided at the origin point for a strict computation to produce a volume weight of the internal pipe or the special packing containers and the fluid or the matters contained therein similar to or identical to a specific gravity of the suspending fluid, so that the internal pipe is in a state similar to weightlessness, which solves a series of problems caused by an attempt to overcome gravity in various conveyance systems; and thus centripetal buoyancy produced by turning, ascending or descending exactly equals centrifugal force. Meanwhile, permanently magnetic objects are respectively provided on the internal pipe and correspondent bases to form a permanently magnetic suspension system to further ensure a relative position of the moving internal pipe; and internal strain of the internal pipe bears a part of unbalanced load on the turnings, so as to solve problems of turning, ascending and descending remaining to be solved in conveyance machines.

In the condition of external flow manner, solving a problem of shape resistance means getting rid of a limitation of streamlines, in such a manner that the surface of the moving object 91 can be designed to be a straight line or other simple line, i.e., regular geometry, so as to pave a flat way for the method that the fluid near the boundary layer moves stratifledly and orderly through manual intervention to reduce the fluid frictional resistance as recited in the description of related arts. The surface of the moving object to be resistance-reduced is provided with at least one layer of at least one movable solid element (resistance reducing films), i.e., "movable walls" as recited in the description of related arts, which have a similar section with the moving object. Different from the condition of internal flow manner, the most external layer of "movable walls", i.e., the external pipes, are almost rigid. Multiple resistance reducing films, also called movable walls, which are able to move stratifledly and orderly and arranged between the external pipes and the bases, move from the surface of the object (a bow or a head of the moving object), move stratifledly and orderly along a moving direction of the fluid until reaching a tail of the surface of the object (a tail of the moving object). According to the description of related arts, the return path is along one side of the object to be resistance-reduced for next circulation. The present invention has the different return path to return to the origin point, i.e., the one-way circulation path; as shown in FIG. 2 and FIG. 33, a channel is opened inside the moving object to connect the bow and the tail as a return path of the "movable walls".

Secondly, resistance to unbalanced pressure is realized as follows.

As recited in the description of related arts, the problem of resistance to unbalanced pressure remains to be solved. Too ideal consideration about operation environments and a straight moving path results in a susceptibility to the unbalanced pressure. Practical application environments are always complicated and harsh. Most unbalanced pressure flows are vertical to a surface of a moving object. However, movable walls has no holes and thus the moving object has a relatively large counter-flow area, so that deformation may be relatively big to further cause relatively big contact frictional resistance and even destroy the operation. As a result, the present invention reduces the counter-flow area facing the unbalanced pressure flows, which means that the movable walls (resistance reducing films) have many holes to reduce a surface area thereof, or that the movable walls are made of grid-shaped or grate-shaped rigid elements. As shown in FIG. 3, holes are left except flexible transversal connecting elements and rigid longitudinal grate-shaped elements. Thus, most pressure directly works on the bases and only a tiny part of the pressure works on the elements of the movable walls. As shown in FIG. 4, the grate-shaped rigid element can have a streamline section similar to an airplane wing and be able to rotate around a rotation axle therein; the grate-shaped rigid element is able to change its counter-flow angle θ with changes of the fluid working forces vertical to the moving direction, so as to automatically produce recovery moment of force to further improve the ability to resist the unbalanced pressure flows. It should be mentioned that, according to the description of related arts, each movable wall of each layer drives the fluid at two sides to move and each movable wall is a boundary face for the fluid nearby, wherein the fluid on the boundary face has a relative velocity of zero to the boundary and a velocity gradient is caused because of shearing forces, which is dependent on viscosity of the fluid. According to the present invention, an interaction between the movable walls and the nearby fluid depends on the different grid-shaped rigid elements or the different grate-shaped rigid elements to continuously move through a zone, and also the fluid flows around the elements to produce flow resistance, so as to drive the fluid near the zone to change moving state. Although the name and similar structures and similar moving manners of the movable walls are kept, the movable walls of the present invention work in totally different principles.

Thirdly, moving positioning is realized as follows.

In order to prevent the movable walls from moving inclinedly, convex and concave courses are respectively provided on each movable wall to ensure normal movement and relative moving positions thereof. In the condition of internal flow manner, when the internal pipe moves so fast as to produce relatively big fluid resistance, the rigid bases and the rigid internal pipe basically maintain positions thereof, so by further providing a plurality of flexible films having a proper rigidity (resistance reducing films), similar to the "movable walls" as recited in the description of related arts, are orderly arranged between the bases and the internal pipe, in such a manner that each resistance reducing film can be moved and a velocity gradient is formed because of a balance of fluid dynamics at two sides of the resistance reducing film. As shown in FIG. 22, in order to prevent the internal pipe from being stuck, a sum of a diameter of the internal pipe and thickness of each flexible film needs to be controlled in certain range, such as 90% to 95% of an internal diameter of the base. The films move according to the certain velocity gradient so as to drive the fluid to move stratifiedly and orderly to further reduce resistance. In order to position locations of the internal pipe, the external pipes and the resistance reducing films (the movable walls) in the process of moving, the concave courses and the convex courses are respectively provided on the internal pipe, the external pipes and the resistance reducing films (the movable walls) to maintain the movement and the relative moving positions. FIG. 5 shows an application in the field of internal flow, wherein a concave course is provided on the base; a convex course on a first movable wall (a first resistance reducing film) matches with the concave course on the base; a convex course on a second movable wall (a second resistance reducing film) matches with the concave course on the first movable wall (the first resistance reducing film) and so forth. All the movable balls are mutually matched one by one and each movable wall has a convex course and a concave course simultaneously except the internal pipe. Meanwhile, the moving state of the internal pipe is controlled by fluid dynamics and permanently suspension forces. As shown in FIG. 5, a certain number of convex courses and concave courses correspondent with each other are provided on an external wall of the internal pipe and internal walls of the external pipes, meanwhile different magnets of identical poles, such as rubber magnets, are spread over the concave courses and the convex courses. When the internal pipe is suspending inside the external pipes and moving forwardly, the convex courses and the concave courses guide the moving direction. The fluid between the courses are half closed, such as providing tiny stripes or threads along a relative moving direction similarly to a thread sealing on ends of each two neighboring resistance reducing films to produce reverse pressure, or simulating a design of labyrinth to produce a labyrinth-like fluid path formed by the resistance reducing films and the walls of the internal pipe and the external pipes. A possibility to crash or to be stuck by the external pipes in straight path is nearly zero. At turnings, theoretically a volume weight of the internal pipe equals a specific weight of the fluid for suspension so that centripetal buoyancy equals centrifugal forces, whereas the volume weight in practical operations may has variance so that a balance of forces is broken. When the internal pipe moves inclindedly to one side, the fluid between the courses is half closed; a flow area of the fluid at the side is reduced, and the velocity of the fluid increases, so that the centripetal buoyancy increases and a first recovery moment of force is formed. Meanwhile, when the internal pipe moves inclinedly to the side, space between the courses is reduced and the different magnets of identical poles applies increased rejecting force to form a second recovery moment of force. Even if a crash does happen, the crash can last for a very short time. The positive pressure is reduced to further reduce the frictional resistance and lead to tiny loss of energy. Thus, the normal movement of the internal pipe at the turnings is maintained. The multiple resistance reducing films between the internal pipe and the external pipes work in identical principles as above and detailed description is omitted here.

As shown in FIG. 22, between the course 66 and the course 67, a part without resistance reducing films of the fluid move faster than a part with resistance reducing films of the fluid. According to similar sealed container hydraulic conveyance technologies, when the fluid velocity increases to a certain level, the container sinking at a bottom can leave the bottom of the pipe, i.e., a so-called "bottom-up velocity", which indicates that action force between the fluid and the container stands against the internal wall of the pipe to be pointed at a center of the pipe and stands vertical to an external wall of the closed container to be pointed at an internal part of the closed container; that the larger relative velocity between two fixed walls and the fluid and the smaller distance between the two fixed walls, the larger action force. Similarly, in the present invention, two forces pointing to the center of the pipes from top and from bottom generated by the fluid dynamics are able to maintain the movement of the internal pipe. Actually more than two "positioning courses" having a relatively big relative velocity can be provided. As shown in FIG. 26, the internal pipe has a section of polygon and a plurality of positioning courses provided thereon. The convex bars and the concave bars on the courses, no matter on the external wall of the internal pipe or on the internal walls of the external pipes, have a certain rigidity and flexibility. When the internal pipe moves inclinedly to one side, the convex bar and the concave bar get closer to each other and the fluid between the correspondent positioning courses are half closed, wherein the convex bar and the concave bar can be screw sealed, in such a manner that the fluid is accelerated to increase the centripetal buoyancy at the turnings to further form the recovery moment of force; the flexible convex bars and concave bars are able to produce contact resilience to recover the internal pipe.

Two neighboring magnet on the courses of the resistance reducing films can have different polarities, or the magnets are provided with an interval of one course, in such a manner that in the return path each resistance reducing film can be overlapped with each other based on practical needs to return along the returning pipes having a relatively small section to the origin point and be separated with each other again after being handled by the origin handling device.

Applications in the fields of rotating flow and the external flow have similar arrangement, wherein each movable wall and its correspondent base are mutually restrained so as to maintain the relative position and the movement order of each resistance reducing film.

Fourthly, an arrangement of movable walls on a curved path is realized as follows.

After taking the above measures, at least one movable wall, i.e., the resistance reducing film, are provided along a curved path or on a curved face. FIG. 6 typically shows that at least one movable wall are respectively provided on a concave face and a convex face of the curved face. The arrangement on the convex face is similar to the condition of external flow manner. According to a force analysis on a tiny portion randomly chosen, pulling forces produced by two ends thereof, a centrifugal force caused by curved movement and an outward action force produced by the nearby fluid moving centrifugally are all in a balance. If encountering with an unbalanced pressure flow moving outwardly from the base, the pulling forces at the two ends are increased for counteraction; if encountering with an unbalanced pressure flow inwardly, the centrifugal force produced by the curved movement and the outward action force produced by the nearby fluid moving centrifugally are produced for counteraction. Adjustment of the weight, the moving velocity, a radius of curvature and a counter-flow position of the base can increase resistibility to unbalanced pressure. The arrangement on the concave face is similar to the condition of internal flow manner. According to a force analysis on a tiny portion randomly chosen, pulling forces produced by two ends thereof, a centrifugal force caused by curved movement and an action force toward the base produced by the nearby fluid moving centrifugally are all in a balance. If encountering with an unbalanced pressure flow moving outwardly to the base, the pulling forces at the two ends are increased for counteraction and a reacting force of the base provides a centrifugal force for the fluid in the curved movement; the way of eliminating impact force on the turning brought by the fluid is describe as follows. If encountering with an unbalanced pressure flow outwardly from the base, rarely happened, the centrifugal force produced by the curved movement and the outward action force produced by the nearby fluid moving centrifugally are produced for counteraction and further expanding and tightening elements are provided along the whole circulation path. An increased self-pulling force or an increased internal strain leads to an increased resistance of a bearing on the rolling cylinder for producing the internal strain, which is acceptable in the practical application. Although a contact friction between two neighboring movable walls is inevitable, the present invention aims to reduce a positive pressure between two contact faces to further reduce frictional loss. For example, in the condition of external flow manner, since the circulation path is short, permanently magnet objects having an identical polarity are laid on the surface of the courses to reduce possible positive pressure on the contact faces, or rolling wheels with strong permanently magnet bearings are installed on some courses, which greatly raise costs but is still acceptable after considering the effects of reducing resistance. In the application in the field of internal flow, because of measures described as follows for reducing and even eliminating the shape resistance, the unbalanced pressure flow is simplified. Two neighboring turnings, as showed in FIG. 7, have approximately identical turning radius, R1 and R2. Internal strains of the movable walls at a connection point thereof are equal and opposite with each other, i.e., counteracted with each other, and thus even rolling cylinders for producing the internal strains can be omitted. The above method can be applied in the designs of each turning in the condition of internal flow manner and in the designs of some turnings in the condition of external flow manner, i.e., when the movable wall turns, the internal strain thereof, rather than a mechanical device such as a supporting roller, bears all the other internal forces and external forces including the centrifugal force required by a weight thereof and the actions forces from the fluid.

Fifthly, special structures of turning parts of the internal pipe and the external pipes which can be opened and closed and other elements are realized as follows.

No matter for the internal flow, for the external flow or for the rotating flow, the movable walls are required to cover the whole surface of the object to be resistance-reduced. It is necessary to divide the section of the object to be resistance-reduced into a plurality of unit and each unit has a certain degree of freedom which means a difficulty in fixation or restriction. For example, an ideal state of internal flow pipe is that many round pipes sharing one axle center is sleeved one by one and move forwardly according to the predetermined velocity gradient. However, the round pipes are able to turn, ascend and descend; after reaching the destination, each round pipe is opened; after returning back to the origin, each round pipe is reclosed, which requires a movable wall to be readily closed and opened, to have a rigid section able to resist the fluid load in the process of moving and to be able to turn along the moving direction. Thus the present invention provides a rigid frame element, which can be readily closed and opened as showed in FIG. 8, on a cross section of the internal pipe at a certain interval, wherein the showed unit element is polygon-shaped. Each unit element is connected by a rotation axle. Two inner angles, provided at two sides of the rotation axle of the polygon-shaped unit element, are respectively $\alpha$ and $\beta$. Each unit rolls up toward one side to certain degree when the unit is not able to roll inwardly any more because of a limitation of the neighboring inner angles and then the unit is sealed to form a rigid frame element able to resist internal pressure and external pressure. It is necessary to mention that two inner angles, $\alpha$ and $\beta$, are not equal. If rolling up to one side forms a relatively large section, rolling up to an opposite side may form a relatively small section to be fit for the returning pipes because a part of units may be overlapped. According to a round pipe conveyance technology, the conveyance belt forms into a round pipe and the opening is controlled by guiding supporting rollers. Similarly, as showed in FIG. 11, the opening and closing of the internal pipe of the present invention are realized at the origin and at the destination and controlled by guiding supporting rollers or guiding concave courses and guiding convex courses. In the process of moving, because of the limitation of the space size of the base, the rigid frame can seldom be opened and a sealing effect may not be good, but in order to adapt to complicated operation environment, sealing latches can be further added. As shown in FIG. 9, a sealing latch 25 is inserted in a reserved latch hole 26. Because the sealing latch 25 is relatively long, it needs relatively big space to unlatch; in the process of moving, a limited space of the base means a difficult unlatching so as to form a stable sealing. The sealing latch is provided on the movable walls specially provided. A closing and an opening of the sealing latch is also controlled by the guiding supporting rollers or the guiding concave courses and the guiding convex course at the origin and at the destination. Thus, once the positions of the guiding supporting rollers or the guiding concave courses and the guiding convex courses are arrangement, the closing and the opening the internal pipe can be automatically accomplished.

The rigid frame elements are spaced according to practical needs and the rigidity of the pipe materials thereof are controlled, so as to limit a smallest turning radius of the internal pipe. FIG. 6 shows at least one resistance reducing film provided along the curved path. FIG. 7 shows an internal pipe moving on a curved face and at least one resistance reducing film provided thereon, wherein the internal strain thereof bears all the other internal forces and external forces including the centrifugal force required by a weight thereof and the actions forces from the fluid at one turning; the internal forces are counteracted with each other and the ability to resist the unbalanced pressure flow is also strengthened at continuous turnings.

A long pipeline includes many turnings. A turning external pipe has a requirement of precision. For example, a cross section area and positions of courses are supposed to be unchanged. This is beyond conventional technologies. Thus turning pipes used at the connection points are specially made by factories in a large scale; the turning pipes have a structure similar to an internal pipe to satisfy requirements of precision and live assembly arts. As showed in FIG. 21, the turning external pipe uses flexible pipes having a proper rigidity like the internal pipe, wherein a plurality of rigid frames 65 are embedded at a certain interval, or being jointed one piece by one piece like a toy snake. The interval between the rigid frames 65 and the rigidity and the flexibility of the pipes determines a smallest radius of curvature at the turnings, which can be realized automatically during the live assembly. However, the flexible pipes are unable to resist over large flow pressure, and thus "protective sleeving pipes" 63 having a large diameter than the flexible pipes and being resistant to high pressure can be sleeved if necessary. The "protective sleeving pipes" 63 and the flexible external pipes can be positioned by fixation devices, or cementing materials such as concrete can be poured between the "protective sleeving pipes" 63 and the flexible external pipes.

The specific weight of the internal pipe changes after unloading, especially when conveying solid matters. Thus a specific weight adjusting device 99 is always further provided on the internal pipe or on the special packing containers of matters. Similarly to a pressure-resistant container of a sealed container car, the sealed container is open and added with light fluid such as the air at the origin and then closed with an O-shaped ring at the seam for sealing, so as to produce relatively big buoyancy. The container can be self-opened because the internal pressure of the system is higher than the outsides and the fluid pressure inside the container. After unloading and being handled by the destination handling device, the sealed container is opened to release the light fluid and even release out of the whole system, reloaded with suspending fluid such as water and returns, so as to realize the adjustment of the specific weight of the internal pipe. FIG. 25 shows the specific weight adjustment device provided on a packing container. If the suspending fluid or the light fluid is unbalanced at the origin and at the destination and it is inconvenient to add or release the suspending fluid or the light fluid at the origin and at the destination, a special pipe adjustment system can be provided between the origin and the destination to adjust the unbalanced fluid.

A driving device, or an energy and power supplying device is described as follows. A powering device of conventional pipeline container conveyance or molded products pipeline conveyance has a low efficiency to deliver energy, such as 10%, a complicated structure and a big energy consumption, but most of the consumed energy is for overcoming the resistance produced by the gravity, such as overcoming a height difference and overcoming a frictional resistance caused by the gravity when the conveyance machine is moving forwardly, which causes a series of problems. The system of the present invention is an enclosed, narrow and long liquid connector, wherein each point in the connector has an identical potential energy; when the objects contained inside, no matter the fluid or the solid matters contained in the containers, have a volume weight identical to the lubricant fluid, a state similar to weightlessness appears. When the origin handling device overcomes the fluid pressure and loads the system with the objects, the pump-typed machine or other similar machine has already delivered the energy required for overcoming the gravity and the height difference, and thus in the process of moving only the energy for overcoming the fluid friction is required, which is a tiny part of the total energy consumption, even if the driving device or the new energy and power supplying device of the present invention has a low delivery efficiency.

The driving device of the present invention has a special driving structure similar to a linear motor. As showed in FIGS. 23 and 34, the driving device of the present invention, 107 and 110, has a secondary device of a permanently magnet body such as a rubber magnet on the internal pipe and a primary device of a device similar to a conveying belt which has wires concealed laid thereon to apply a driving force on the secondary device by charging with direct currents. Specially, the linear motor of the present invention has a mobile primary device and a mobile secondary device having an identical moving velocity, and thus the two devices closely sticks to each other without wear, wherein a magnet gap therebetween is very tiny and the advantage of a high delivery efficiency of the linear motor is fully taken.

The pump-typed machine is usually specially designed, especially when the objects are solid or highly viscous and enter and leave the system through replacement. Conventional pressure pumps can be used for the general fluid to deliver energy. The objects are loaded in the special packing container 101 after precise computation. The special packing container has a section adapted to the internal pipe and is able to turn, ascend and descend with the internal pipe therein. The special packing container also can have the specific weight adjusting device. The special packing container can be pressure-resistance based on the object nature and operation requirements, flexible, waterproof or fit for ready loading and unloading the objects, which are all simple conventional arts. No detailed description is stated here. The pump-typed machine, or a pump having an exit and an entrance, as showed in FIG. 24, includes a pressure-resistance barrel 74 (barrel chamber), a movable sealing board 72 for opening and closing the exit and the entrance on the barrel 74, a movable valve board 73 for opening and closing the exit and the entrance of the system and some other related auxiliary elements. The objects which are loaded into the special packing container after a precise computation at the origin enter the system by following steps: firstly, when the movable sealing board 72 is open and the movable valve board 73 is closed, the special packing container for containing the solid matters enter the barrel chamber of the pressure-resistance barrel 74; secondly, the movable sealing board 72 is closed, when the barrel chamber is able to resist pressure and the movable valve board 73 is open, in such a manner that the packing container enters the system and the suspending fluid inside the system is replaced and enters the barrel chamber 74; thirdly, the movable valve board 73 is closed and the replaced suspending fluid in the barrel chamber of the pressure-resistance barrel 74 is sucked into the system by a pump; and fourthly, a movable sealing board 72 is opened and a next circulation begins. A pumping device for unloading 105 at the destination is basically identical to a pumping device for loading 99 and works at exactly opposite steps to the pumping device for loading. In order to satisfy a requirement of water proofing, the second step may include a replacement of compressed gas; in order to maintain that the objects have no contacts with the suspending fluid before entering the internal pipe, the suspending liquid replaces the air at an identical pressure. For a two-way conveyance, the special packing container containing objects conveyed from the destination can be for the replacement. Sometimes, the origin has an elevation higher or lower than the destination, which means different designs of the pump-typed machine. These are all simple conventional arts and no more description is stated here.

Moreover, in some fields such as a super-long-distance conveyance and an upward and downward conveyance for mines, the height different between the origin and the destination is extremely big, and the external pipe and the pump-typed machine can be very complicated in order to resist high pressure brought by extremely high suspending fluid, which means expensive costs. Thus the system of a large height difference is separated into at least two subsystems having greatly reduced height difference, which is similar to providing several transfer stations therebetween whose origin handling devices and destination handling devices are basically identical to the original system stated above. No reloading is required and thus the loading device for the precise computation can be omitted.

In the application of external flow, as showed in FIG. 33, some elements are designed as the application of internal flow; however, the two applications are slightly different. For example, in the state of external flow, the based is provided at an internal side of the external pipes and the resistance reducing films; the external pipes and the resistance reducing films have many holes in order to resist greatly unbalanced pressure. Actually the external pipes and the films of the two applications are basically identical and thus the external pipes and the films in the application of the external flow can be designed as FIG. 27. The section of the base is a polygon. The convex (concave) bar is provided at each angular point on the base, and the whole circulation path is handle like this; a circle of concave (convex) bars able to move along the convex bars are provided thereon, in such a manner that the expanding and tightening element of the external pipes are formed and the two circles of bars are mutually repelling and courses and mutually limit moving positions. The curved portions of the circulation path are designed as FIG. 6 and FIG. 7, wherein the internal strain thereof bears all the other internal forces and external forces including the centrifugal force required by a weight thereof and the actions forces from the fluid at one turning; the internal forces are counteracted with each other at continuous turnings. Thus the convex (concave) bars have internal strains like a conveying belt, plus a positioning function of the courses, in such a manner that a stable longitudinal section is formed. For the cross sections, the convex (concave) bar is connected with the longitudinal grate-shaped element on each angular point; because the external pipes and the resistance reducing films are required to indent along the return path, the longitudinal grate-shaped elements use telescopic sleeving pipes. As showed in FIG. 10, the telescopic sleeving pipe comprises an internally stretching portion of a telescopic portion and an externally covering portion of the telescopic portion. The telescopic sleeving pipe can be elongated when provided on an external surface and able to bear the internal strains, or can directly use telescopic elements. In order to overcome complicated external forces, by laying a permanently magnetic object on the surface of the course, or installing a rolling wheel having a strong permanently magnetic bearing on some circulation paths, adjusting the counter-flow angle θ of the grate-shaped rigid element and applying an outward stain on the resistance reducing film, the polygon on the cross section is nearly rigid and the layer of resistance reducing films forms a stable moving structure. By identical methods, at least one resistance reducing film which are able to move at a certain velocity gradient are orderly arranged outwardly. In order to further strengthen the structure to resist complicated external interference, courses can be properly added between two angular points. When the polygon or other shape on the section fails to be closed, devices for producing non-contact forces such as electromagnetic forces can be simultaneously provided at two ends failing in the closure to continue delivering the internal forces and the cross sections remain stable.

Similar to the internal pipe and the resistance reducing films in the condition of the internal flow manner, the opening and the closing of the external pipes and the resistance reducing films are controlled by guiding devices. The resistance reducing films can be designed to overlap with each other. The driving device can be similar to the structure as recited in FIG. 23, or be the linear motor as the condition of the internal flow manner.

Sixthly, a method for reducing the shape resistance is realized as follows.

When the fluid impacts with the solids, the relative velocity between the fluid and the fixed wall is big and the impacting has a certain degree or even a vertical impacting, following fluid breaks through the leading fluid and directly crashes with the fixed walls because of inertia and thus the crash energy and the momentum loss between the fluid and the fixed walls are extremely huge, which is a main part of the shaped resistance. If the impact on the fixed walls of the fluid at the turnings can be prevented, the problem of the shaped resistance can be solved. As the customs in fluid mechanics stated above, a series of resistance reducing devices applied in various fields are induced into a method as follows.

As showed in FIG. 13, a cylinder includes many straight vanes 37 divided into many grids filled with the fluid. The straight vanes 37 are fixed with the wall of the cylinder 38. When the cylinder rotate, the fluid inside has a direction changed all the time, but restrictions by the vanes produce a solid and none direct impacting between the fixed walls 38 appears, i.e., no energy loss and no momentum loss.

If the wall of the cylinder is fixed and the vanes and the fluid form a circular motion, as showed in FIG. 12, extra movable walls 36 for reducing frictional resistance are further provided on the wall of the cylinder. According to an analysis on a tiny grid, the fluid on the upper triangular zone has no impacting loss because of similar and even identical velocity and direction with the vanes and restrictions by the vanes to be similar to a solid; the fluid at the contacting zone with the wall of the cylinder basically has no impacting loss because the vanes are always vertical to the wall of the cylinder and thus the fluid approximately moves at a tangent line of the wall of the cylinder, wherein action forces on the fluid of the wall of the cylinder includes a shearing force paralleling with the tangent line of the wall the cylinder, i.e., the fluid frictional resistance, which is reduced by a movable wall 36, and a shearing force vertical to the tangent line of the wall of the cylinder for providing a centripetal force for the fluid to turn, wherein no inevitable impacting between the fluid and the solid can be seen because a moving state of the fluid is solidified in the process of turning.

As a result, the method for reducing the shape resistance of the present invention is following. Vane-shaped solids, devices or machines are inserted vertically to a moving velocity direction at a certain interval in the fluid, so as to divide the fluid into many limited zones to further limit the movement and solidify the moving state thereof, which disables the fluid to directly crash with the fixed walls despite of inertia and keeps the moving velocity direction of the vane-shaped device or machine identical to the predetermined tangent lines of the fixed walls, in such a manner that a reacting force on the fluid of the fixed wall and an action force on the fluid of the vane-shaped device are vertical to the moving direction of the fluid to further compulsorily force the fluid to gradually change a velocity direction along the fixed walls and avoid the impacting loss between the fluid and the fixed walls.

Different fields have different application mechanical devices and different composition designs, combined with the design of reducing frictional resistance, which means that the fluid near the boundary layer moves stratifiedly and orderly after manual intervention to reduce the frictional resistance and to finish a process of the fluid resistance reduction when it is necessary. The vane-shaped device and the manual intervention device are further applied on driving forces to move faster than the fluid and apply action forces on the fluid to propel as a propulsion device. As the customs in fluid mechanics stated above, the series of resistance reducing devices applied in various fields are induced into the "method", despite belonging to a device.

Different fields have different application devices. The condition of external flow manner relates to reductions of the shape resistance the frictional resistance. Firstly, the shape resistance on the bow and the tail of the moving object is solved to get rid of limitation of streamlines; then as showed in FIG. 2, frictional resistance reducing devices (temporarily named as self-resistance reducer 97) are provided at two narrow and long sides. The method for reducing the shape resistance includes providing a counter-flow resistance reducer 96 at the bow of the moving object for dispersing the fluid on the moving path of the counter-flow face of the moving object and turning by changing a relatively small velocity direction to discharge the fluid to longer distance at two sides, because a focused discharging into a narrow and small zone can lead to too much fluid pressure at the exits and entrances to reduce resistance; meanwhile, a tail pressure increaser 98 is always provided to gradually focus and guide the fluid at two sides near the tail of the moving object to be discharged to the tail so as to counteract with a tail low pressure zone. The machine for changing a direction of the fluid can be a fluid turning sliding vane pump as showed in FIG. 15, which simulates a vane pump and has a relatively big frictional wear between the sliding plates and the fixed wall 44 and a relatively big size. Thus a pulley is provided at a tail of the sliding vane 44 and the pulley rolls along a first fixed orbit 43 and a second fixed orbit 46 predetermined on the rolling cylinder. The vane also can be a telescopic vane as showed in FIG. 16 to form a fluid turning telescopic vane pump, wherein a tertiary vane element 51 is sleeved in a secondary vane element 50 and telescopic; the secondary vane element 50 is sleeved in a primary vane element 49 and telescopic. The three vane elements 49, 50 and 51 have a circuit arrangement similar to the driving method of the linear motor, wherein the upper and the lower elements are mutually a primary device and a secondary device of the linear motor to control expanding and contracting of the vanes. The vanes like this have a quick response speed and adaptability to harsh environments. Two pumps form a double-turning runner as showed in FIG. 17 which changes a direction of the fluid twice and only a tiny angle difference $\phi$ of the velocity direction and leads to tiny loss of kinetic energy and momentum of the fluid and the moving object. The double-turning runner is fit for a wide path from the entrance to the exit. Only one pump can form a single-turning runner as showed in FIG. 18 which changes the direction of the fluid once and at a very tiny angle $\phi$, fit for a narrow counter-flow area. The single-turning runner can use a straight telescopic turning pump as showed in FIG. 20 which is produced by twining a rolling cylinder 62 with movable walls provided with telescopic vanes 60 showed in FIG. 16. A guiding orbit 61 is provided at an internal side at the turnings to guide a moving path of the vane. The vanes can be gradually inserted into the fluid along a relatively long distance to reduce loss of momentum and kinetic energy caused by a disaccord between the vane angle and the fluid velocity direction at the entrance; when the vanes contract, the fluid is driven to move, which helps change the direction of the fluid and better helps change the direction of the air. The various runners are orderly provided on the counter-flow face. As showed in FIG. 19, the fluid on the cross section of the moving object to be resistance-reduced is divided into several zones, wherein the fluid of each zone correspondently enters the single-turning runner and the double-turning runner; the fluid is dispersed after changing a relatively small velocity direction and discharged to relatively long distances in front of the bow of the moving object, and then flows to the tail, in such a manner that the shape resistance is greatly reduced.

In the above solution, wet area, or the contact area with the fluid, is greatly increased so that the fluid frictional resistance is also greatly increased. In the various runners, multiple resistance reducing films can be respectively provided or provided in combinations as described in the condition of internal flow manner to reduce the fluid frictional resistance. When the fluid moves fast, more attention should be paid on designing a combination for reducing the frictional resistance and a speed of expanding and contacting should be reduced to avoid a loss of secondary energy caused by mechanical resistance and avoid over complicated mechanical design. If necessary, fixed vanes can be used, or a height of the vane can be reduced and intervals between the vanes can be reduced. The above solution is also embodied as a propulsion device.

In the single-turning runner, a resistance reducing pump-typed machine having a movable surface can be provided, or a pump-typed machine as showed in FIG. 28 can be installed too. The pump-typed machine has a base of an arc-shaped fixing board having a predetermined radius of curvature or a structural supporting board 85; concave courses or convex courses are provided on the base as moving orbits; further at least one concave bar or convex bar moving along the fixing boards are provided on the concave course or the convex courses which intersect and bind on the rolling cylinders having several rolling wheels of different diameters, wherein a velocity gradient is formed by controlling the velocity through different radius of rolling wheels. Magnets of identical polarity can cover on the surface of the concave courses or the convex courses and connecting elements, provided between the concave bars or the convex bars, can be flexible or rigid, or can have many holes. Thus at least one resistance reducing film, or "movable wall", moving along a curved path are formed and have a section as showed in FIG. 29, wherein fixed vanes or telescopic vanes are provided on the most external movable wall; in order to prevent the most external bar from moving off the orbit, a positioning pole or a positioning board 89 is provided to form a restrained, rigid and stable structure with the bar provided on another face of the runner to ensure a longitudinal positioning. FIG. 30 shows the rolling cylinder, wherein concentric rolling wheels 88 having different radiuses are arranged on a rotating axle 87. The concentric rolling wheels 88 has a similar structure with the description of related arts and FIG. 30 only shows velocity controlling relationships between the resistance reducing films. On one side of the return path, the resistance reducing films are provided with a similar structure moving to the opposite direction similarly to the description of related arts; a mechanical device like this has a disadvantage that a partial area becomes a counter-flow area to cause shaped resistance. Thus a counter-flow resistance reducing block is provided on the bow to disperse the fluid on the zone and change a direction of the fluid to discharge the fluid to two relatively long distances at the two sides. The resistance reducing films are so small that it is difficult to arrange the movable resistance reducing films and thus streamlined guiding vane 90 is used. The streamlined guiding vane 90 changes a relatively small velocity of the fluid and guides the fluid toward two sides. FIG. 31 shows a combination of the streamlined guiding vanes on a surface of a runner FIG. 32 shows the pumping device provided in the double-turning runner, whose streamlined guiding vanes are also combined as showed in FIG. 31. FIG. 33 shows the resistance reducing propulsion device of the present invention applied in the field of external flow, wherein the moving object has a regular geometry shape and thus the external surface of the moving object is mainly exerted with the flowing fluid frictional resistance. FIG. 34 shows the resistance propulsion device of the present invention applied in the field of internal flow and illustrates connections among the origin handling device, the destination handling device, the driving device, structures at the turnings, the container and the internal pipe, and the resistance reducing films.

All above pumps or mechanical devices, including the counter-flow resistance reducer and the tail pressure increaser, and manual intervention devices can be further designed into propulsion devices or force pumps for applying driving forces on the fluid, which is similar to the description of related arts and the conventional technology. No more description is stated here The counter-flow resistance reducer is slight improved and reversely installed on the tail of the moving object to work as the tail pressure increaser, so as to realize the attempt to gradually focus the fluid at the two sides near the tail and guide the fluid to discharge the fluid to the tail to counteract with the tail low pressure zone, so as to eliminate the limitation of stream lines.

In the condition of internal flow manner, turning pipes or turning channels can be provided as showed in FIG. 14, wherein multiple movable walls or resistance reducing films for reducing the fluid frictional resistance are provided on the smooth fixed wall 40; vanes 42 arranged at a predetermined interval along a vertical direction to the velocity direction to move with the fluid the most internal movable wall, i.e., the internal pipe, so as to limit the impacting on the fixed wall 40 of the fluid, which reduces not only the frictional resistance but also the shape resistance. During designing, a turning radius of the internal pipe is possibly maximized and a density and a height of the vanes are preferred to be possibly increased for better effects, because the vanes are mainly for preventing the impact on the fixed wall, i.e., the pipe wall, of the fluid. The maximal distance to arrange the next vane is determined by an intersection point of a line along a top of the vane and paralleling with the fluid moving velocity direction at the top and the pipe wall. It is the same case with the resistance reducing films, which means that the vanes have short vanes or swellings arranged at a predetermined interval vertically to a moving direction to move with the fluid to reduce the shaped resistance.

The vanes can be combined with the rigid frame elements which can be closed and opened in the internal pipe. However, the vane groups are always separated with the internal pipe for cleanliness and maintenance and connected alone to the special connecting pole to form a structure similar to the internal pipe. The vanes are designed as the frame of the internal pipe. The vane groups are packed into the internal pipe when the internal pipe are being closed, separated with the internal pipe when the internal pipe is opened at the destination, closed to a different side after being cleaned specially and packed into the internal pipe to return.

Seventhly, a system and a device applied and realized in the field of rotating flow are realized as follows.

The device in the field of rotating flow is simple and has a section as showed in FIG. 12. In the cylinder, a rotating axle made of many straight vanes 37 separate the whole space into many tiny grids filled with the fluid. The straight vanes 37 can be changed into curved vanes practically. Obviously the vanes limit and move with the fluid to basically eliminate the shaped resistance. Extra resistance reducing films are provided to eliminate fluid frictional resistance with the fixed wall of the cylinder. Similar to the condition of internal flow manner, the films have courses mutually matched; permanently magnetic devices are provided on the films; the films are designed to be controlled by the fluid dynamics. In order to satisfy special requirements such as resistance to the unbalanced pressure and unloading, in such a manner that relative positions and moving orders of the resistance reducing films are controlled, wherein the resistance reducing films can have many holes, can include grid-shaped rigid elements or grate-shaped rigid elements as described as follows. Other elements can be produced as or similarly to the condition of internal flow manner and the condition of external flow manner or other conventional arts. No more description is stated.

The present invention has advantages describe in the description of related arts. Moreover, the present invention solves the fluid frictional resistance while solving the shaped resistance, which is a breakthrough in resistance reduction compared to the conventional arts and the description of related arts; the present invention arranges the movable walls on a curved face and greatly increases the resistibility to the unbalanced pressure flow from harsh operation environment. In the field of external flow, the present invention breaks a restriction of traditional stream lines to produce simple application products in various fields and reduce costs. In the field of internal flow, the one-way circulation path solves the problem of maintenance and simplifies the structure to be fit for small pipe and small channels, which is extremely important for the internal flow conveying pipes of tens, hundreds or thousands of kilometers long. In the field of the rotating flow, the present invention is able to reduce the viscous resistance while reducing the shaped resistance and breaks limitations of small-sized application products such as rotating flow separator; when the present invention works as a conveyor, the present invention breaks limitations of difficulties in the turnings, the ascents, the descents and the sealing and small size, reduces energy consumption and increase loading. The present invention is realized in simple methods and simple devices and at low costs compared to the conventional arts and fit for industrial promotion. As a great breakthrough in the fluid resistance reducing technology, the present invention is able to be applied in fluid reduction including water conservancy, aviation, navigation, underwater sports, transportation, national defense and pipeline transportation for reducing fluid resistance and to propel or add pressure These and other objectives, features, and advantages of the present invention will become apparent from the following detailed description, the accompanying drawings, and the appended claims.

Figure 1:
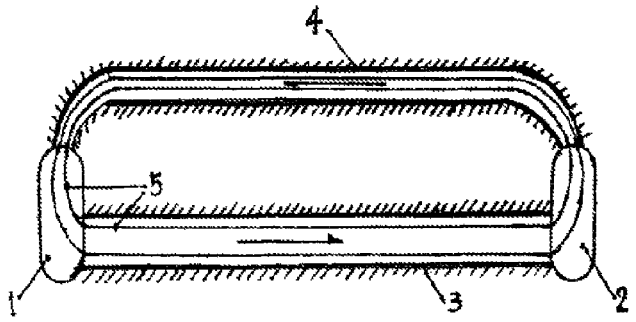
FIG. 1 is a sketch view of a device applied in a field of internal flow according to a preferred embodiment of the present invention.

1—origin and origin handling device of internal flow conveyance; 2—destination of destination handling device of internal flow conveyance; 3—external pipes of internal flow conveyance; 4—internal pipe, resistance reducing films and external pipeline for suspending fluid returning specially provided; 5—at least one resistance reducing film provided on surfaces of pipes or channels and internal pipe; 6—surface of moving object of external flow; 7—resistance reducing films and internal pipe for lubricant fluid returning specially provided; 8—at least one resistance reducing film provided on surface of moving object; 9—hood of counter-flow resistance reducer of moving object; 10—flexbile transversal connecting element on resistance reducing films; 11—rigid longitudinal grate-shaped element on resistance reducing films; 12—rotation axle; 13—rotatable longitudinal grate-shaped element; 14—fixed surfaces of internal flow pipes or channels; 15—concave course provided on fixed surface of internal flow pipe or channel; 16—first resistance reducing film and concave and convex courses thereon on surface of internal flow; 17—second resistance reducing film and concave and convex courses thereon on surface of internal flow; 18—third resistance reducing film (or internal pipe) and concave and convex courses thereon on surface of internal flow; 19—resistance reducing films on curved face; 20—fixed wall or base; 21—fixed wall or base of an internal flow pipe or channel; 22—continuously turning internal pipe (and resistance reducing films); 23—rotation axle on connecting element on rigid cross section of internal pipe; 24—unit on rigid cross section of internal pipe; 25—latch for sealing and connecting rigid cross section of internal pipe; 26—latching hole for sealing on rigid cross section; 27—internally stretching portion of telescopic portion of longitudinal grate-shaped element for external flow; 28—externally covering portion of telescopic portion of longitudinal grate-shaped element for external flow; 30—guiding supporting roller; 31—guiding convex course; 32—guiding concave course; 34—internal pipe and resistance reducing films; 35—fixed cylinder wall; 36—resistance reducing films of rotating flow; 37—straight rotation vane; 38—cylinder wall connected to straight vane; 40—pipe or channel wall of internal flow; 41—internal pipe and resistance reducing films of internal flow; 42—vane for reducing shape resistance; 43—first fixed orbit; 44—sliding vane; 45—pump shell; 46—second fixed orbit; 47—pulley at tail of vane; 48—rotation axle of pump; 49—primary vane element; 50—secondary vane element; 51—tertiary vane element; 52—fluid turning pump; 53—first double-turning runner; 54—second double-turning runner; 55—third double-turning runner; 56—fourth double-turning runner; 57—first single-turning runner; 58—streamlined hood; 59—fixed wall of bow part of moving object; 60—telescopic vane; 61—guiding orbit; 62—rolling cylinder; 63—protective sleeving pipe on external pipe of external flow; 64—turning external pipe of internal flow; 65—rigid frame of turning external pipe; 66—rubber magnet of internal pipe; 67—rubber magnet on base; 68—wall of internal pipe and resistance reducing film; 69—base; 70—driving rolling cylinder; 71—primary device having charging wires concealedly laid; 72—movable sealing board at entrance and exit; 73—movable valve board for opening and closing system; 74—pressure-resistant barrel; 75—O-typed sealing ring; 76—covering board of sealed container; 77—special packing container and its mouth; 78—pressure-resistant container for adjusting specific weight; 79—external pipe wall; 80—convex and concave bars on internal pipe; 81—convex and concave bars on external pipe of internal flow; 82—base and convex (concave) bar thereon of external flow; 83—course made by convex (concave) bars on external pipe; 84—connecting element between convex (concave) bars on each resistance reducing films; 85—fixing board; 86—concave (convex) bar; 87—rotation axle; 88—rolling wheel; 89—positioning pole (board); 90—streamlined guiding vane; 91—moving object; 92—resistance reducing film on self-resistance reducer; 93—suspending lubricant fluid; 94—resistance reducing film on counter-flow resistance reducer; 96—counter-flow resistance reducer; 97—self-resistance reducer on moving object; 98—tail pressure increase; 99—pumping device for loading and specific weight adjusting device; 100—device for transmitting packing container; 101—packing container which is loaded with matters and has specific weight adjusted; 102—empty packing container; 104—suspending lubricant fluid spread all over internal pipe; 105—pumping device for unloading; 107—driving device on leave path; 108—second driving device on return path.

DETAILED DESCRIPTION OF THE PREFERRED EMBODIMENT

First Preferred Embodiment

Figure 12:
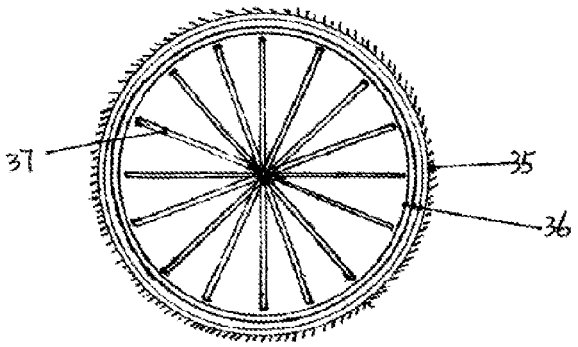
FIG. 12 is a sketch view of fluid rotating with straight vanes inside a fixed cylinder according to the preferred embodiment of the present invention.
Figure 13:
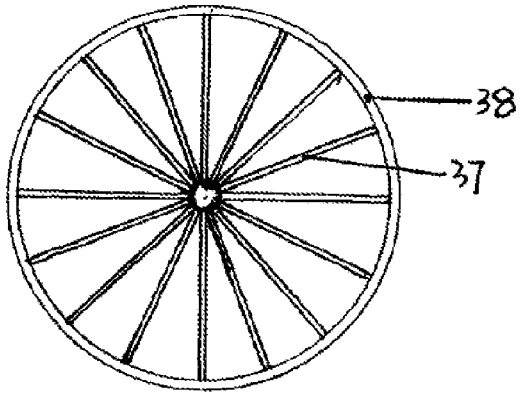
FIG. 13 is a sketch view of fluid in a cylinder rotating with the cylinder and straight vanes according to the preferred embodiment of the present invention.
Figure 14:
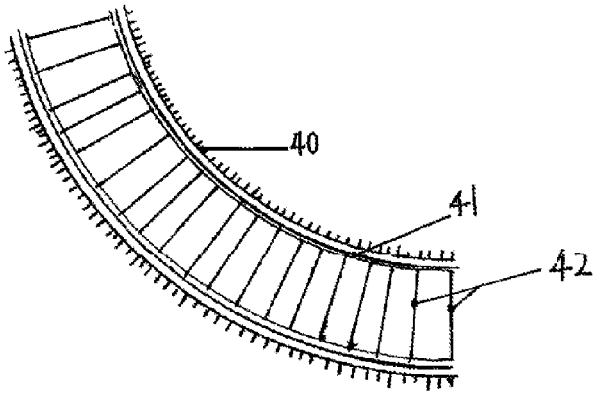
FIG. 14 is a sketch view of an arrangement of vanes in the condition of internal flow manner according to the preferred embodiment of the present invention.
Figure 15:
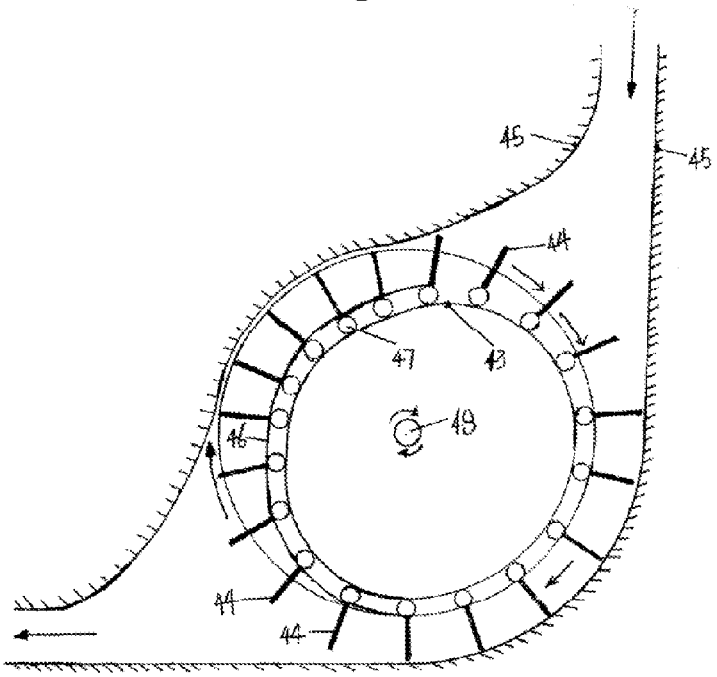
FIG. 15 is a sketch view of a fluid turning sliding vane pump according to the preferred embodiment of the present invention.
Figure 16:
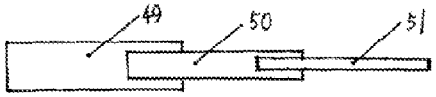
FIG. 16 is a sketch view of telescopic vanes according to the preferred embodiment of the present invention.
Figure 17:
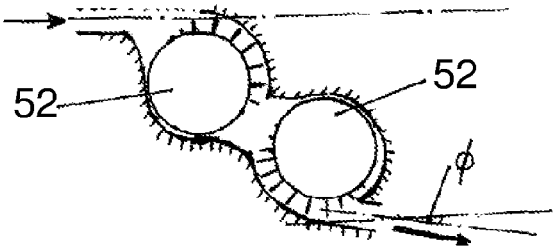
FIG. 17 is a sketch view of a double-turning runner according to the preferred embodiment of the present invention.
Figure 18:
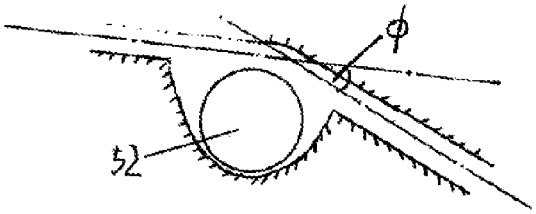
FIG. 18 is a sketch view of a single-turning runner according to the preferred embodiment of the present invention.

According to the first preferred embodiment of the present invention, a rotating flow separator improved by the present invention has a diameter of 1 m and a cross section as showed in FIG. 12, wherein five to ten pieces of resistance reducing films having many holes are provided along an internal wall and several courses are provided on each movable wall whose sum of thickness and an interval equals 1 cm, totally 5 cm to 10 cm; wherein 40 straight vanes as thick as 2 mm are provided and connected to a power supplying device through a rotation axle to drive fluid to rotate and separate at a high speed. Thus separator not only has reduced energy consumption but also reduced wear between the fluid and container wall, so as to break limitation of small size.

Second Preferred Embodiment

Figure 8:
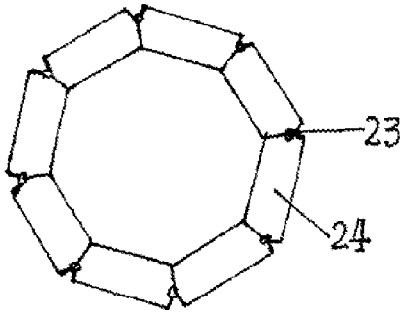
FIG. 8 is a sketch view of a rigid cross section including each unit of an internal pipe or an external pipe according to the preferred embodiment of the present invention.
Figure 9:
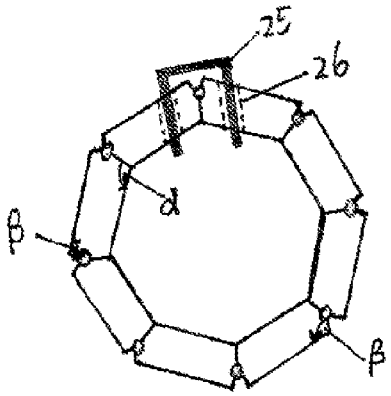
FIG. 9 is a sketch view of a sealing latch provide on the rigid cross section of the internal pipe according to the preferred embodiment of the present invention.
Figure 22:
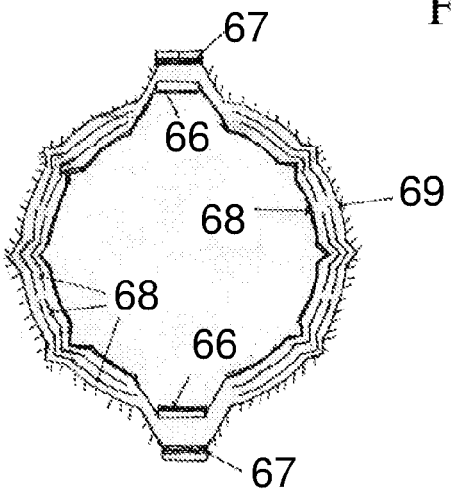
FIG. 22 is a sketch view of an arrangement of the resistance reducing films according to the preferred embodiment of the present invention.
Figure 23:
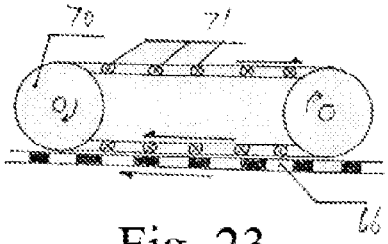
FIG. 23 is a sketch view of a driving force according to the preferred embodiment of the present invention.
Figure 24:
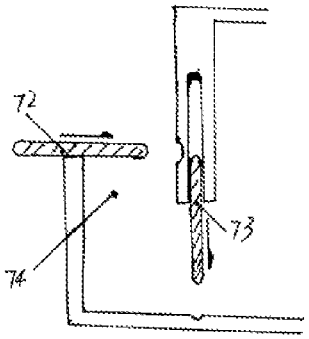
FIG. 24 is a sectional view of a pump having an exit and an entrance according to the preferred embodiment of the present invention.
Figure 25:
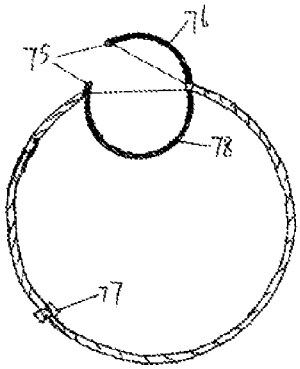
FIG. 25 is a sectional view of a specific weight adjusting device according to the preferred embodiment of the present invention.

A water conveying pipeline connecting two places is needed. The pipeline is 80 km long; a height difference is about 12 m; the pipe has a diameter of 2 m. The pipe has a section as showed in FIG. 22. Twenty resistance reducing films are provided along internal wall. Thirty courses are provided on each film and its base. A sum of thickness of each resistance reducing film and an interval therebetween equals 5 mm, totally 10 cm long. Four positioning courses are provided. Each rigid frame as showed in FIG. 8 and FIG. 9 is provided on internal pipe at an interval of 1 m. Each straight vane, as high as 10 cm, is provided on the internal pipe at an internal of 50 cm. The vane groups can be separated with the internal pipe. The smallest turning radius of the pipeline is controlled more than 200 m. Because frictional resistance and partial resistance are basically eliminated, the water is able to move 10 m/s. The internal pipe and the resistance reducing films are opened at the destination and rolled up to an opposite side to return. After being handled by a destination handling device, the resistance reducing films are partially overlapped and recombined to enter a return path. The return path pipe has a diameter of 30 cm, starts from a destination to an origin and parallels with a leave path.

The Third Preferred Embodiment

Figure 26:
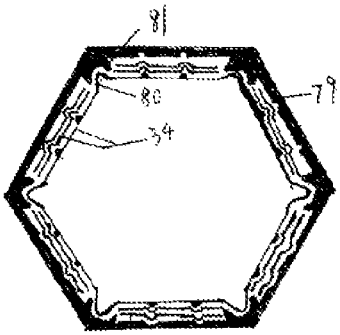
FIG. 26 is a sectional view of positioning coursed according to the preferred embodiment of the present invention.

A pipeline connecting a mountain top and a factory for conveying minerals is needed. The pipeline is 120 km long and has a diameter of 40 cm and a section as showed in FIG. 26. Three resistance reducing films are provided along an internal wall and 15 courses are provided on each film and its base. A sum of thickness of each resistance reducing film and an interval therebetween is 5 mm, totally 1.5 cm. Six positioning courses are provided. The internal pipe is improved from a conveying belt having a steel core. Each rigid frame as showed in FIG. 8 and FIG. 9 is provided at each interval thereon to resist unbalanced pressure. The minerals are primarily smashed, packed in special packing containers after being precisely weighed by an origin handling device, wherein a row of the origin handling devices and destination handling devices may be provided for speeding up loading and unloading; the special packing containers are soft and unable to resist internal fluid pressure, and thus a specific weight adjusting device able to resist the fluid pressure is attach thereon. During loading, the adjusting fluid such as water in the specific weight adjusting device is poured out; then the specific weight adjusting device is filled with air and closed; the smashed minerals are packed into the special packing containers and enter system through a special pump stated above. Permanently magnetic objects are provided on the internal pipe. A driving device is a special linear motor stated above. The smallest turning radius is controlled more than 200 m. Water is taken as suspending fluid and the specific weight is controlled as 1. During loading, a volume weight of the internal pipe and the special packing container is strictly controlled between 0.98 and 1.02. The internal pipe is opened after being handled by the destination handling device, rolls up to an opposite side, unload the special packing container and load the empty packing container 102 already having the specific weight adjusted to enter the return path with the suspending fluid. The return path has a diameter of 20 cm, starts from the destination to the origin and parallels with a leaving path. The left special packing containers leave the system through the special pumps and are unloaded the minerals therein. The specific weight device opens the special packing containers, fills in with water to adjust the specific weight, and enters the system through the special packing container to return. The water replaced out by the special pumps are pressed into the system with a common high-pressure pump.

Fourth Preferred Embodiment

Figure 2:
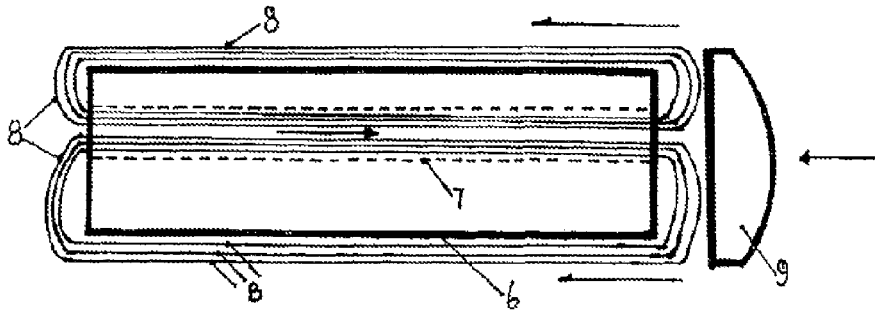
FIG. 2 is a sketch view of a device applied in a field of external flow according to the preferred embodiment of the present invention.
Figure 3:
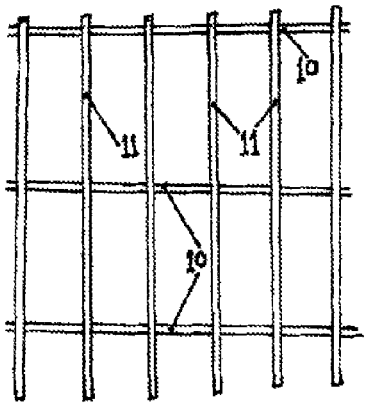
FIG. 3 is a sketch view of a resistance reducing film having many holes according to the preferred embodiment of the present invention.
Figure 4:
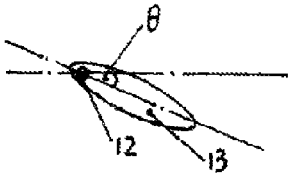
FIG. 4 is a sectional view of a rotatable longitudinal grate-shaped element provided on the resistance reducing film according to the preferred embodiment of the present invention.
Figure 5:
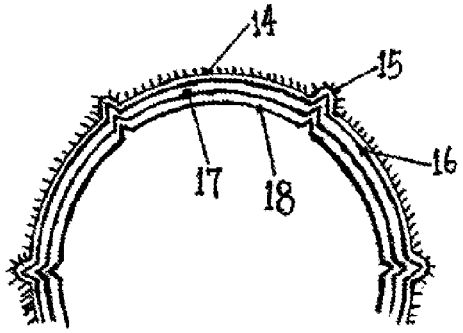
FIG. 5 is a sketch view of positions of courses mutually matched provided on the resistance reducing films in the condition of internal flow manner according to the preferred embodiment of the present invention.
Figure 6:
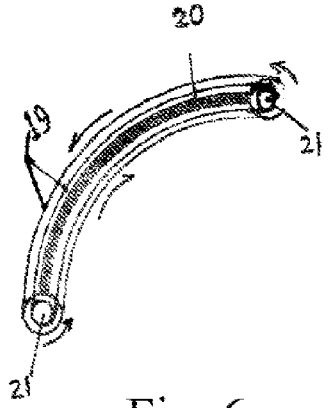
FIG. 6 is a sketch view of the resistance reducing films provided on a curved face according to the preferred embodiment of the present invention.
Figure 7:
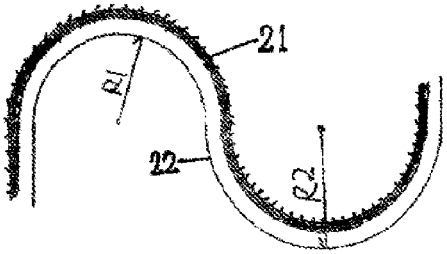
FIG. 7 is a sketch view of an arrangement of the resistance reducing films on two neighboring turnings in the condition of internal flow manner according to the preferred embodiment of the present invention.
Figure 10:
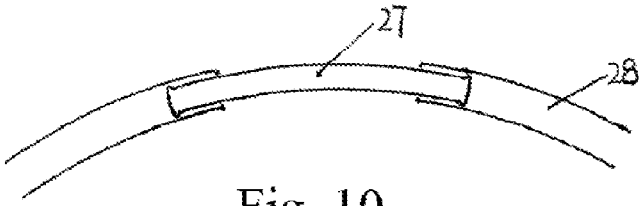
FIG. 10 is a sketch view of a telescopic portion of the longitudinal grate-shaped element in the condition of external flow manner according to the preferred embodiment of the present invention.
Figure 11:
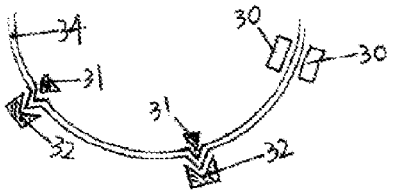
FIG. 11 is a sketch view of a guiding device for guiding an opening, a closing and a moving of the internal pipe or the resistance reducing films according to the preferred embodiment of the present invention.
Figure 19:
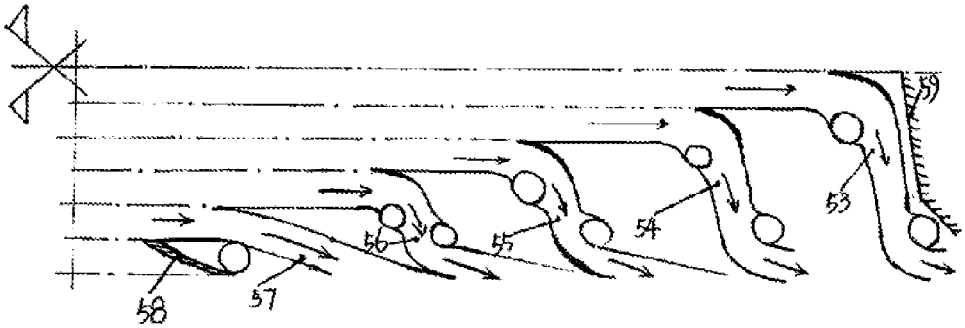
FIG. 19 is a sketch view of an arrangement of each runner on a hood of a counter-flow resistance reducer according to the preferred embodiment of the present invention.
Figure 20:
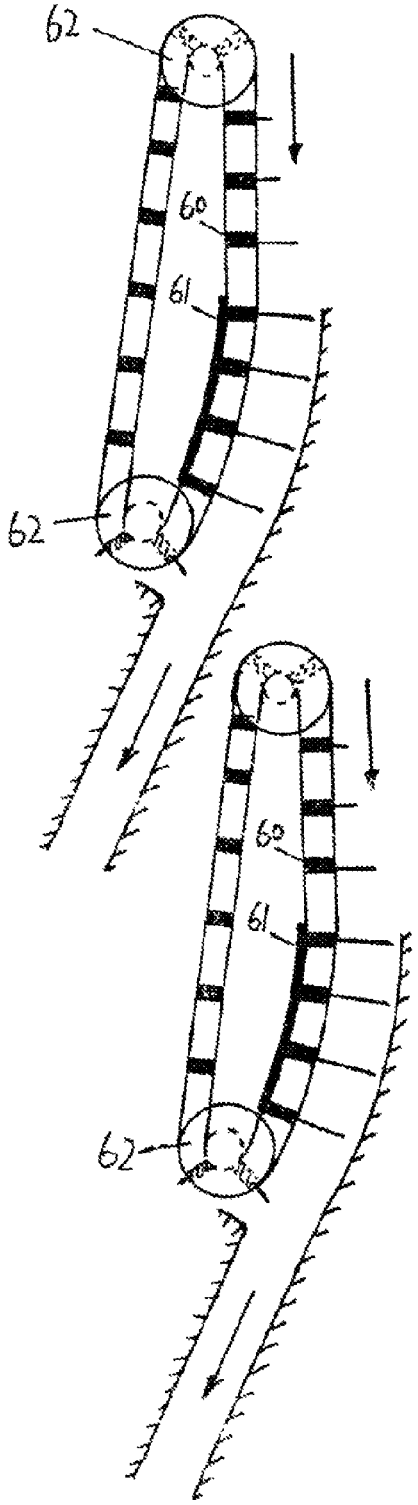
FIG. 20 is a sketch view of a straight turning pump having the telescopic vanes, correspondent single-turning runners and a combination thereof according to the preferred embodiment of the present invention.
Figure 21:
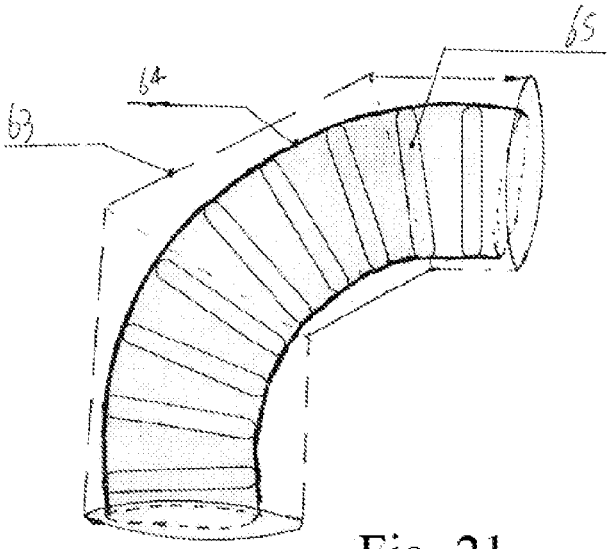
FIG. 21 is a perspective view of a turning external pipe according to the preferred embodiment of the present invention.
Figure 27:
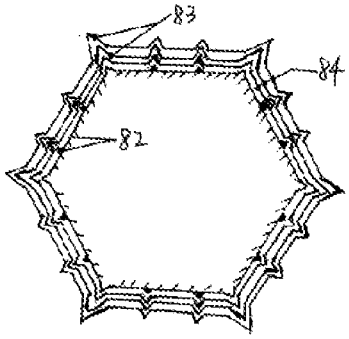
FIG. 27 is a sectional view of a structure applied for external flow according to the preferred embodiment of the present invention.
Figure 28:
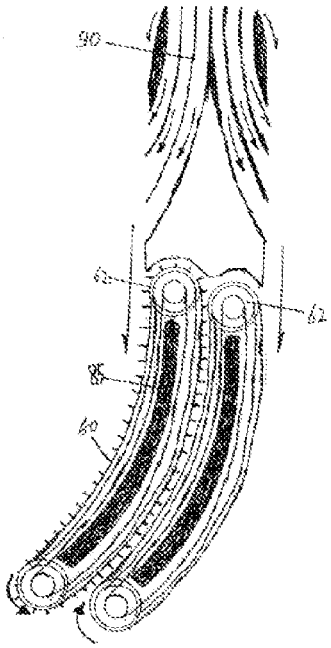
FIG. 28 is a sketch view of a movable pump on a surface of the single-turning runner according to the preferred embodiment of the present invention.
Figure 29:
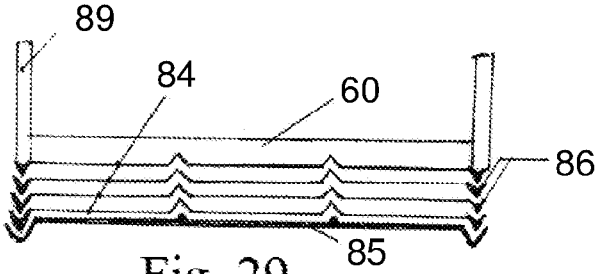
FIG. 29 is a sectional view of the movable pump on the surface of the single-turning runner according to the preferred embodiment of the present invention.
Figure 30:
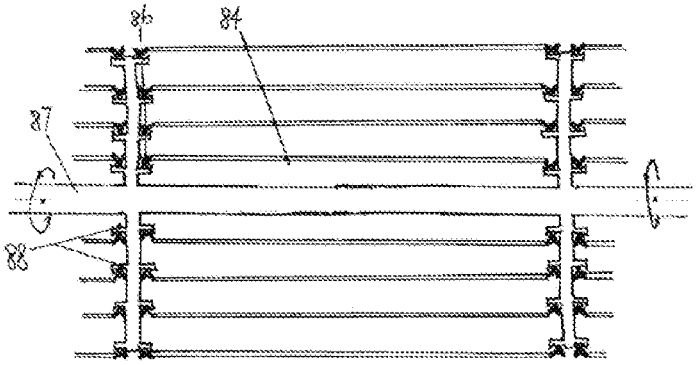
FIG. 30 is a sketch view of rolling cylinders of the movable pump on the surface of the single-turning runner according to the preferred embodiment of the present invention.
Figure 31:
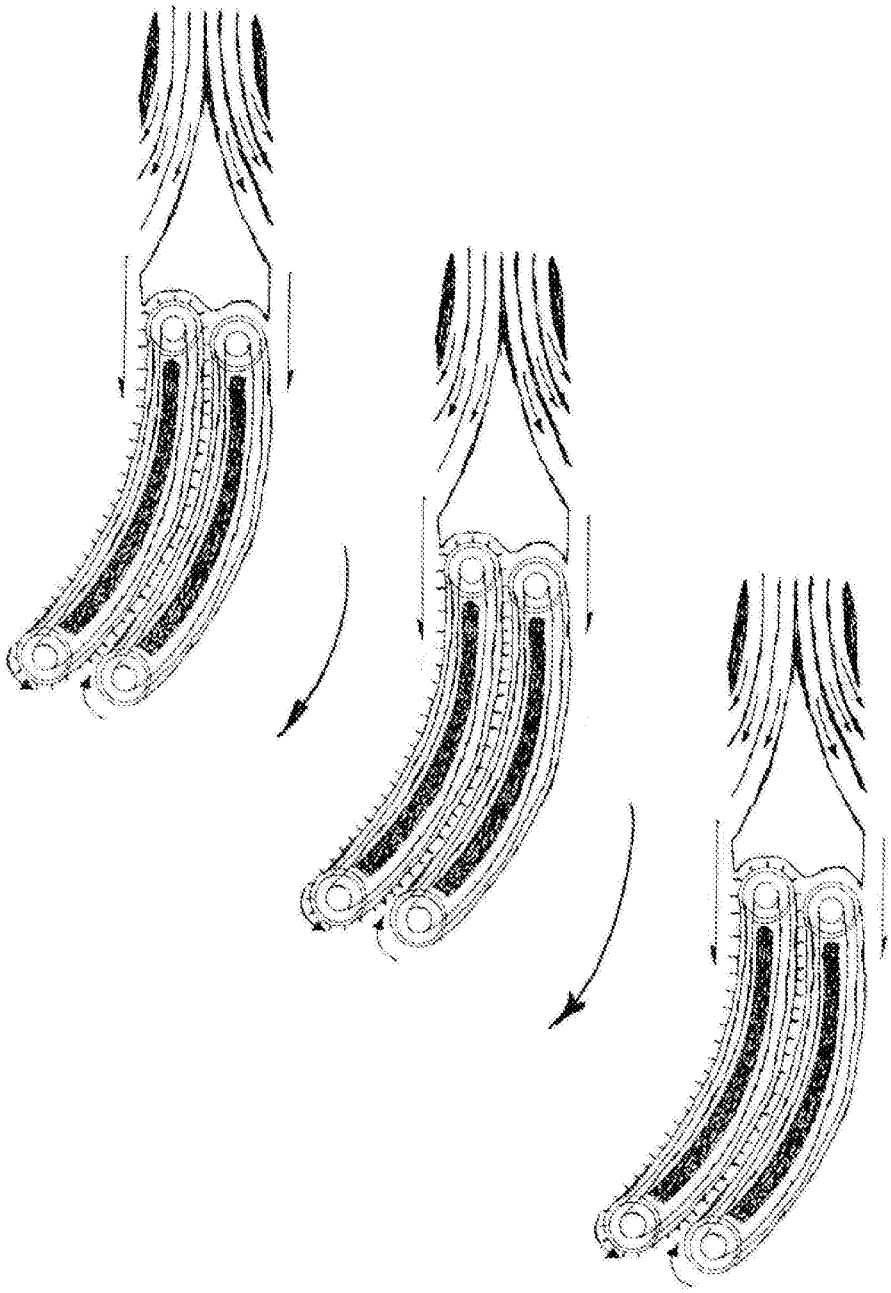
FIG. 31 is a sketch view of a combination of the movable pumps on the surface of the single-turning runner according to the preferred embodiment of the present invention.
Figure 32:
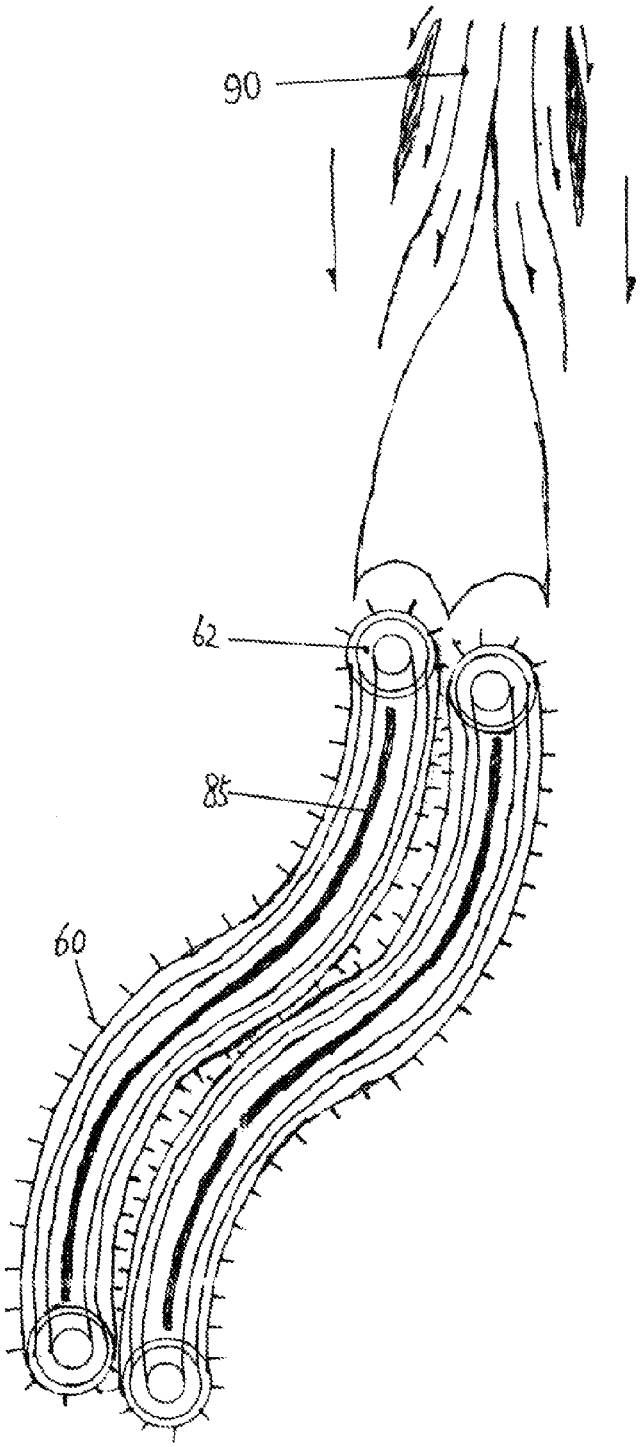
FIG. 32 is a sketch view of a movable pump on a surface of the double-turning runner according to the preferred embodiment of the present invention.
Figure 33:
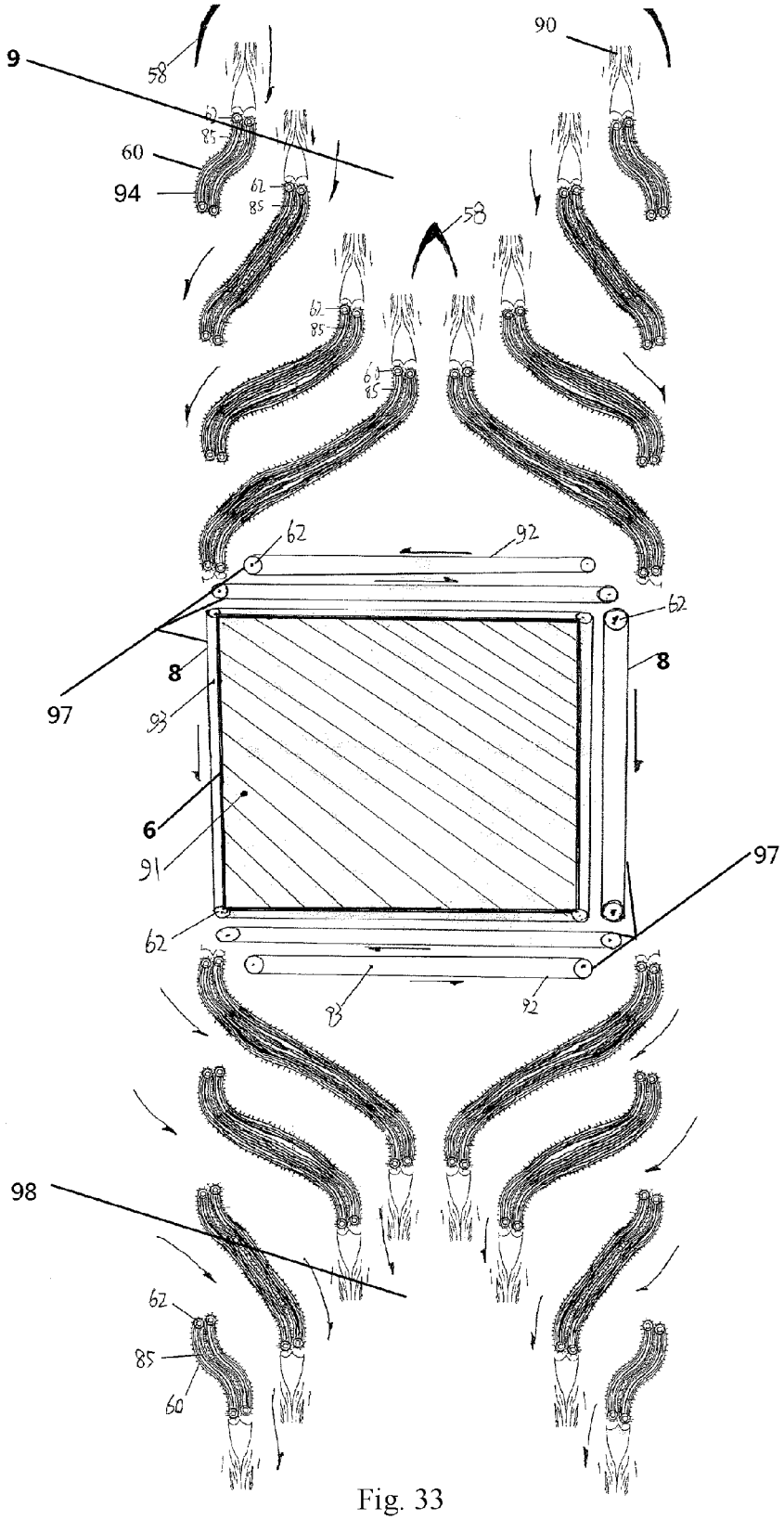
FIG. 33 is a sketch view of a resistance reducing propulsion device applied in the field of external flow according to the preferred embodiment of the present invention.
Figure 34:
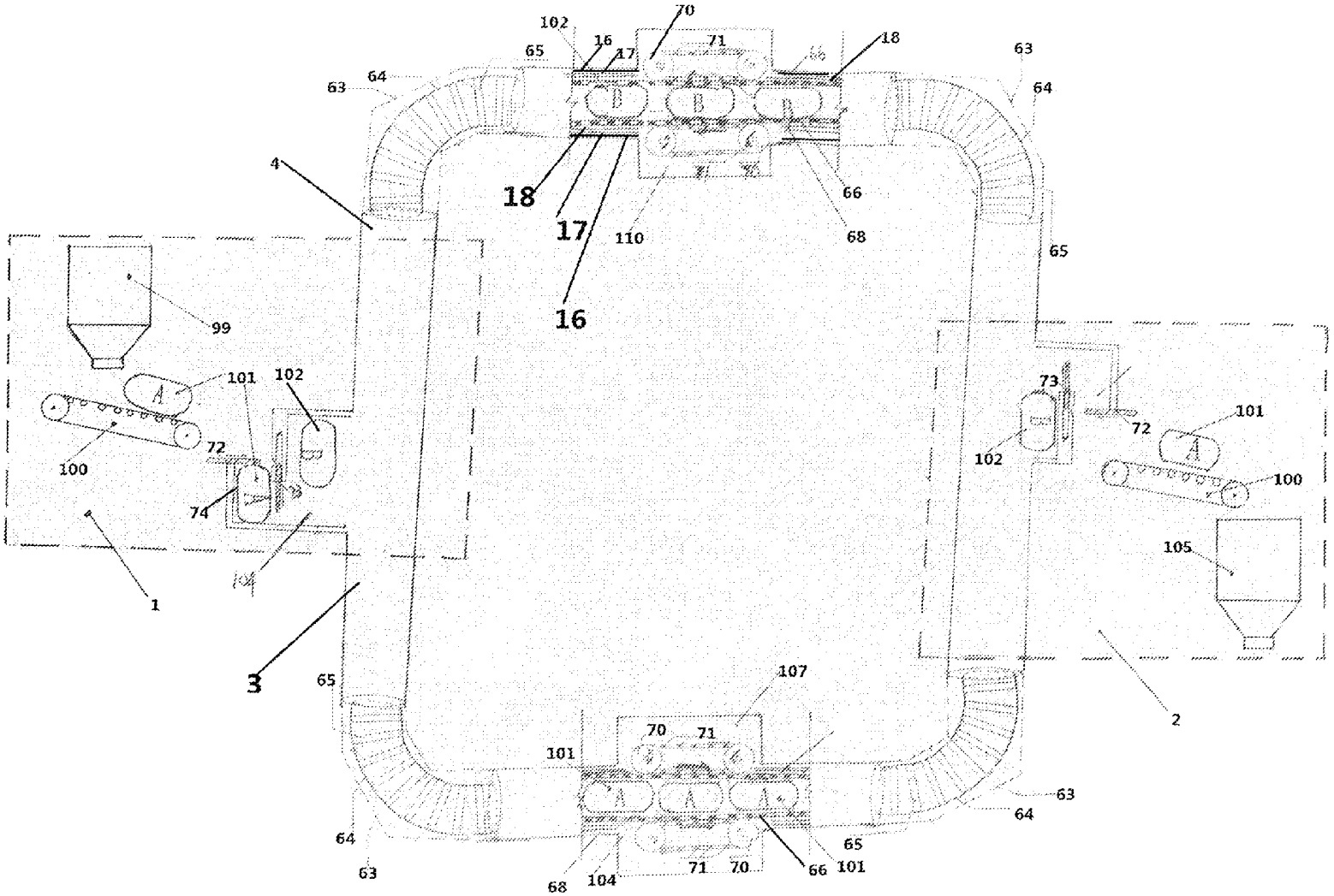
FIG. 34 is a sketch view of the resistance reducing propulsion device applied in the field of internal flow according to the preferred embodiment of the present invention.

A new ship, according to the fourth preferred embodiment of the present invention, breaks a limitation of stream lines. The ship body is cubic, as showed in FIG. 2. The ship is 12 m wide, 6 m high and around 120 m long. Around 20 resistance reducing films are installed thereon to reduce frictional resistance. 200 courses are provided on each resistance reducing film and its base. A sum of thickness of each film and an interval therebetween is 5 mm, totally 10 cm. Each resistance reducing film uses a telescopic grate-shaped element as showed in FIG. 10 to limit a possibly stretching range to produce a rigid cross section as showed in FIG. 27. A return path, provided inside the ship body, is a rectangular channel having a diameter of 2 m. Permanently magnetic suspension systems are also provided along the whole circulation path to expand or to tighten, in such a manner that longitudinal sections are stable and able to resist wave pressure. Runners of counter-flow resistance reducer are as showed in FIG. 19. Two sides are respectively divided into 12 zones, respectively 50 cm wide and 6 m high; correspondently 11 runners are provided, wherein 6 runners are double-turning runners and 5 runners are single-turning runners; an entrance of each runner is 50 cm wide and 6 m high. A hood of the counter-flow resistance reducer is around 40 m long. A turning pump having the double-turning runner can be a device having a movable surface as showed in FIG. 32 and a correspondent combination thereon can be similar to FIG. 31. A turning pump having the single-turning runner can be a device having a movable surface as showed in FIG. 28, a correspondent combination thereon can be similar to FIG. 31. A tail pressure increaser has a similar structure and an opposite moving direction and installation direction to the counter-flow resistance reducer. The tail pressure increaser can be omitted and the tail is streamlined and gradually contracted. The resistance reducing films provided thereon are arranged as proving movable walls on a curved path.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A resistance reducing propulsion device, comprising a counter-flow resistance reducer, a frictional resistance reducing device for reducing a frictional resistance, and a tail pressure increaser mounted at a tail of a moving object, for an external flow; and further comprising an origin handling device, a destination handling device, external pipes, an internal pipe, a packing container, suspension lubricant fluid, at least on resistance reducing film, a driving device and rotation axles, for an internal flow, wherein said suspension lubricant fluid fills in space between said internal pipe and said external pipes to form an enclosed suspension system; further comprising vane-shaped devices inserted at a certain interval along a vertical direction to a fluid moving velocity direction in fluid, wherein said vane-shaped devices are inserted in said fluid to divide said fluid into a plurality of limited zones; a moving velocity direction of each of said vane-shaped devices is identical to a predetermined direction of a tangent line of fixed wall on a surface of the moving object to be resistance-reduced; said at least one resistance reducing film moving stratifiedly and orderly are provided on the surface of the moving object to be resistance-reduce along a moving direction of said fluid, in such a manner that each resistance reducing film moves stratifiedly for orderly moving said fluid.

2. The resistance reducing propulsion device, as recited in claim 1, wherein said counter-flow resistance reducer has a pump-typed machine which has a base of an arc fixing board with a predetermined radius of curvature; convex or concave courses are provided on said base and work as orbits; at least one concave or convex bar able to move along said fixing board are arranged on said concave or convex courses and intersect and twin around rolling cylinders having rolling wheels of different wheel diameters; a velocity gradient is formed by controlling a moving velocity of said pump through different rolling wheel radiuses; surfaces of said concave or convex bars can be covered by magnetic objects having identical polarity; connecting elements are provided between said concave or convex bars for connecting; in order to prevent said most external bar from moving off said orbit, a positioning pole moving with said fluid is provided and forms a restrained stable structure by contacting with said bars provided at a face of a runner to ensure longitudinal positioning.

3. The resistance reducing propulsion device, as recited in claim 2, wherein a counter-flow resistance reducing board is provided at a front end of said pump-typed machine; said counter-flow resistance reducing board comprises a plurality of streamlined guiding vanes symmetrically provided and is for dispersing said fluid on said zones contacting with said streamlined guiding vanes, turning said dispersed fluid and driving said turned fluid to move toward two sides.

4. The resistance reducing propulsion device, as recited in claim 1, wherein said external pipes, said internal pipe and said resistance reducing films move from the surface of the object, move stratifiedly and orderly along said moving direction of said fluid until reaching a tail of the surface of the object and return back to an origin along a return path, i.e., a one-way circulation path.

5. The resistance reducing propulsion device, as recited in claim 1, convex courses and concave courses are respectively provided on said internal pipe, said external pipes and each said resistance reducing films; each two neighboring course are mutually matched with each other.

6. The resistance reducing propulsion device, as recited in claim 1, wherein said internal pipe and said external pipes are able to be closed and opened; a rigid frame which is able to be opened and closed is provided in a pipe body of said internal pipe; expanding and tightening elements are provided on said external pipes and said resistance reducing films and a complete circulation path to form stable structures on cross sections and on longitudinal sections thereof.

7. The resistance reducing propulsion device, as recited in claim 6, wherein said rigid frame of said internal pipe rolls up to one side to form a relatively big section, and then rolling up said rigid frame of said internal pipe to an opposite side forms a relatively small section because a part of said rigid frame is overlapped.

8. The resistance reducing propulsion device, as recited in claim 6, wherein an interval between said rigid frames of said internal pipe limits a turning radius of said internal pipe.

9. The resistance reducing propulsion device, as recited in claim 6, wherein a sealing latch is provided on said rigid frame of said internal pipe and is inserted in a reserved latching hole; during operation said base has no enough space for unlatching and thus a stable sealing is accomplished.

10. The resistance reducing propulsion device, as recited in claim 1, wherein said driving device is a linear motor comprising a primary device and a secondary device which move at an identical velocity and closely stick with each other, wherein one of said primary device and said secondary device is provided on said internal pipe or said external pipe.

11. The resistance reducing propulsion device, as recited in claim 1, wherein said origin handling device and said destination handling device each comprises a pump-typed machine which transforms energy by replacement to overcome fluid pressure and load matters into said closed suspension system and or unload the matters out of said closed suspension system.

12. The resistance reducing propulsion device, as recited in claim 1, wherein a computing device is provided in said origin handling device for computing and controlling matters and a specific weight adjusting device is provided on said internal pipe or on said packing container, in such a manner that a volume weight of said internal pipe or said packing container and the matters therein is close to or identical to a specific weight of said suspension lubricant fluid to maintain a suspension state of said internal pipe.

13. The resistance reducing propulsion device, as recited in claim 1, wherein at least one course between said internal pipe and said external pipes have no said resistance reducing films, which increases a relative moving velocity of said fluid compared with a situation that each course is provided with said resistance reducing films, so as to position; permanently suspension systems are provided on said courses without resistance reducing films.

14. The resistance reducing propulsion device, as recited in claim 1, wherein said fluid between said courses are half closed; tiny stripes or threads are provided along a relative moving direction, similarly to a thread sealing, on ends of each two said neighboring resistance reducing films to produce reverse pressure; a fluid channel formed by said resistance reducing films and walls of said internal pipe and said external pipes are labyrinth-like to form a sealed labyrinth-like structure.

15. The resistance reducing propulsion device, as recited in claim 1, wherein correspondent areas of a bow of the object to be resistance-reduced are connected to correspondent areas at two sides by said counter-flow resistance reducer, a fluid on a counter-flow face of the bow of the object to be resistance-reduced is dispersed gradually and discharged onto two predetermined distances at two sides after a velocity direction is changed; while a case of a tail is just opposite.

16. The resistance reducing propulsion device, as recited in claim 1, each of said vane-shaped devices comprises a plurality of vanes; a maximal distance to arrange a next vane is determined by an intersection point of a line along a top of a vane and paralleling with a fluid moving velocity direction at said top and pipe wall.

17. The resistance reducing propulsion device, as recited in claim 1, wherein grate-shaped rigid elements having a streamlined section, provided on said resistance reducing films moving stratifiedly and orderly, are able to rotate around a rotation axle therein and adjust a counter-flow angle with changes of fluid action forces vertical to a moving direction.

* * * * *